US007244690B2

(12) United States Patent
Omata et al.

(10) Patent No.: US 7,244,690 B2
(45) Date of Patent: Jul. 17, 2007

(54) THERMAL TRANSFER IMAGE RECEIVING SHEET AND METHOD FOR MANUFACTURING THE SAME

(75) Inventors: Takenori Omata, Tokyo-to (JP); Taro Suzuki, Tokyo-to (JP); Masamitsu Suzuki, Tokyo-to (JP); Yoji Orimo, Tokyo-to (JP)

(73) Assignee: Dai Nippon Printing Co., Ltd., Tokyo-to (JP)

( * ) Notice: Subject to any disclaimer, the term of this patent is extended or adjusted under 35 U.S.C. 154(b) by 245 days.

(21) Appl. No.: 10/811,511

(22) Filed: Mar. 29, 2004

(65) Prior Publication Data

US 2004/0242415 A1 Dec. 2, 2004

(30) Foreign Application Priority Data

Mar. 31, 2003 (JP) ..... 2003-093577

(51) Int. Cl.
*B41M 5/035* (2006.01)
*B41M 5/50* (2006.01)

(52) U.S. Cl. ..... 503/227; 156/244.4; 156/244.16; 428/32.39

(58) Field of Classification Search .. 428/32.39–32.52; 503/227

See application file for complete search history.

(56) References Cited

U.S. PATENT DOCUMENTS 6,514,659 B1 * 2/2003 Dontula et al. ..... 430/201

FOREIGN PATENT DOCUMENTS

JP 06-239040 * 8/1994

* cited by examiner

*Primary Examiner*—Bruce H. Hess
(74) *Attorney, Agent, or Firm*—Ladas & Parry LLP

(57) ABSTRACT

It is an object of the invention to provide a thermal transfer image receiving sheet which can enhance sensitivity by low heat conductivity and can be easily manufactured at a low cost compared with the lamination of a foaming film. In a thermal transfer image receiving sheet 1 wherein a thermal insulation layer 5 and a dye receiving layer 8 are formed on a base material sheet 2, the thermal insulation layer 5 is formed by extrusion-molding a resin containing at least one of a foaming agent and hollow bodies. The resin extruded at the time of forming the thermal insulation layer 5 is inserted between the base material sheet 2 and the base material film 6, and the base material sheet 2 and the base material film 6 are bonded to each other via the thermal insulation layer 5. The dye receiving layer 8 is formed outside of the base material film 6.

5 Claims, 4 Drawing Sheets

THERMAL TRANSFER IMAGE RECEIVING SHEET AND METHOD FOR MANUFACTURING THE SAME

BACKGROUND OF THE INVENTION

1. Field of the Invention

The invention relates to a thermal transfer image receiving sheet which is used with a thermal transfer sheet superposed.

2. Description of the Related Art

A method for forming a full-color image by superposing a thermal transfer sheet and a thermal transfer image receiving sheet each other is known as a method for forming an image using thermal transfer. In the thermal transfer sheet, a sublime dye as a record material is supported on a base material sheet such as paper and a plastic film. In the thermal transfer image receiving sheet, a receiving layer for the sublime dye is formed on one surface of the paper and the plastic film. Since the sublime dye is used as a color material in the method, a density gradation can be freely adjusted in dot units, and the same full-color image as a manuscript can be expressed on the receiving sheet. Since the image formed by the dye is very clear and excellent in transparency, the image also excels in the reproducibility of neutral tints and gradation, and the high-quality image equal to the image of a daguerreotype can be formed.

In a sublime thermal transfer type printer, a dye receiving layer consisting mainly of a dyeable resin with a dye (a resin having the character to be easily dyed with a dye) is preferably formed on the base material of the image receiving sheet so as to form a print image with high image quality on the receiving sheet at high speed. When a paper material such as a coat paper and an art paper are used for the base material of the image receiving sheet, the sensitivity receiving the dye on the receiving layer is lowered since the thermal conductivity of the materials is comparatively high.

Then, a biaxial stretched foaming film which consists mainly of a thermoplastic resin such as polyolefin, is used for a base material of the image receiving sheet and has voids therein can be used. Since the image receiving sheet in which the film is used for the base material has uniform thickness, flexibility, and thermal conductivity being smaller than that of paper or the like consisting of cellulose fiber, there is the advantage that the image having uniform and high density can be obtained. However, when the biaxial stretched film is used for the base material of the image receiving sheet, the residual stress at the time of drawing is eased by heat at the time of printing, and the film is shrunk in a drawing direction. As a result, curl and wrinkle are generated on the image receiving sheet, and trouble such as paper jam may be caused on paper when the image receiving sheet travels in a printer.

There is an example in which a laminate sheet constituted by laminating a biaxial stretched foaming film having voids to a core having a relatively small thermal shrinkage or a core having large elastic modulus is used for the base material of the image receiving sheet so as to improve the drawbacks. A thermal transfer image receiving sheet exists, wherein a non-foaming plastic film is superposed to a core via an adhesive containing a foaming agent, and the adhesive layer has a porous structure by foaming the foaming agent in the state (see Japanese Patent Application Laid-Open No. 6-239040). Also, a technique is known, in which a porous layer coating liquid obtained by mixing hollow particles with a binder resin is coated on a base material sheet, and thereby a porous layer is formed (see Japanese Patent Application Laid-Open No. 2002-212890).

However, since the biaxial stretched film having voids has large retractility, it is difficult to control the tension at the time of laminating, and thereby productivity is lowered. Also, the manufacturing cost is greatly increased. The management of a coating condition requires time when the porous layer coating liquid is coated.

It is an object of the invention to provide a thermal transfer image receiving sheet which can enhance sensitivity due to low heat conductivity and can be easily manufactured at a low cost compared with the lamination of a foaming film and the coating of a coating liquid. It is another object of the invention to provide a method for manufacturing the same.

SUMMARY OF THE INVENTION

The above object of the invention is achieved by providing a thermal transfer image receiving sheet having a thermal insulation layer and a dye receiving layer formed on a base material sheet, wherein the thermal insulation layer is formed by extrusion-molding a resin containing at least one of a foaming agent and hollow bodies, the base material sheet and a base material film are bonded to each other via the thermal insulation layer so that the resin extruded at the time of forming the thermal insulation layer is inserted between the base material sheet and the base material film, and the dye receiving layer is formed outside of the base material film.

Since the thermal insulation layer is interposed between the dye receiving layer and the base material sheet, and contains at least one of the foaming agent and the hollow bodies, the thermal transfer image receiving sheet has low heat conductivity, and thereby sensitivity thereof can be enhanced. Since the base material sheet is bonded to the base material film at the time of extrusion-molding of the thermal insulation layer, work for laminating the foaming film and work for coating a coating liquid can be obviated, and the thermal transfer image receiving sheet can be easily manufactured at a low cost. A solvent type adhesive which is conventionally used for adhering the foaming film to the base material sheet can be obviated, and the influence of the residual solvent can be eliminated.

In the thermal transfer image receiving sheet according to the invention, the dye receiving layer may be formed after bonding the base material sheet to the base material film. Also, the dye receiving layer may be formed before bonding the base material sheet to the base material film. The foaming agent is preferably foamed so as to reduce thermal conductivity when the resin contains the foaming agent. The foaming agent is preferably foamed while being extruded and molded. The thermal insulation layer may be formed to be multitiered with a skin layer extrusion-molded integrally on at least one side of the resin, the skin layer comprising none of the foaming agent and hollow bodies.

The above object of the invention is achieved by providing a method for manufacturing a thermal transfer image receiving sheet including a base material sheet, a thermal insulation layer and a dye receiving layer, comprising the steps of: bonding the base material sheet and a base material film to each other via the thermal insulation layer, while extrusion-molding a resin containing at least one of a foaming agent and hollow bodies to form the thermal insulation layer, so that the resin extruded at the time of forming the thermal insulation layer is inserted between the base material sheet and the base material film; and forming the dye receiving layer outside of the base material film.

The thermal transfer image receiving sheet according to the above invention is composed by the method for manufacturing, and the above effects can be displayed.

In the method for manufacturing the thermal transfer image receiving sheet according to the invention, the dye receiving layer may be formed after bonding the base material sheet to the base material film. Also, the dye receiving layer may be formed before bonding the base material sheet to the base material film. When the resin contains the foaming agent, the foaming agent may be foamed while the resin is extrusion-molded. The thermal insulation layer may be formed to be multitiered with a skin layer extrusion-molded integrally on at least one side of the resin, the skin layer comprising none of the foaming agent and hollow bodies.

DETAILED DESCRIPTION OF THE INVENTION

Figure 1:
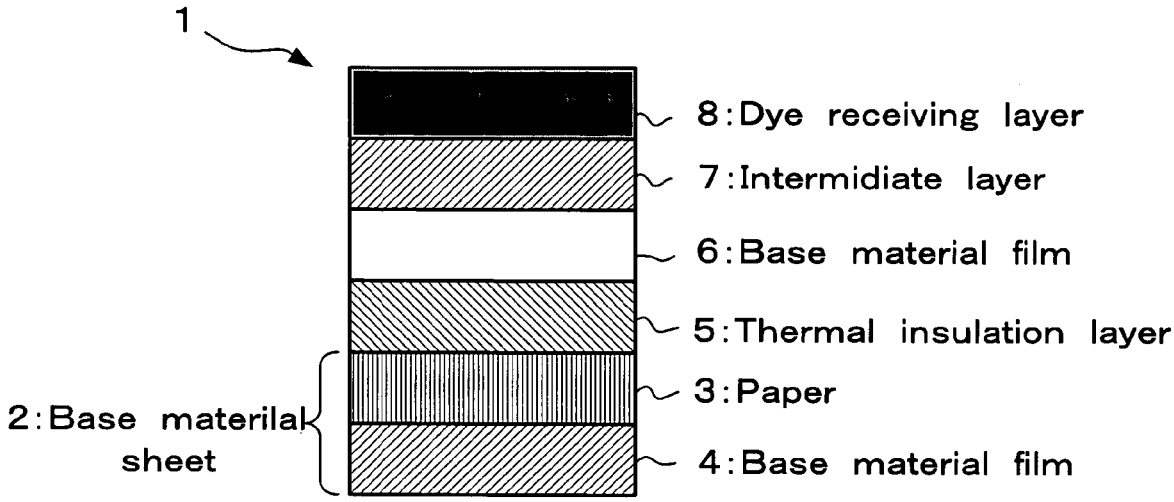
FIG. 1 is a schematic view showing an example of a thermal transfer image receiving sheet according to the invention.

FIG. 1 shows the sectional structure of a thermal transfer image receiving sheet 1 according to an embodiment of the invention. In FIG. 1, each layer with fixed thickness is drawn as a matter of convenience regardless of the thickness of the each layer in an actual thermal transfer image receiving sheet. The thermal transfer image receiving sheet 1 shown in FIG. 1 comprises a base material sheet 2 constituted by bonding a base material film 4 to the rear surface of paper 3, a thermal insulation layer 5 bonded to the surface of the paper 3 of the base material sheet 2, and a base material film 6, an intermediate layer 7 and a dye receiving layer 8 which are bonded sequentially to the outside of the thermal insulation layer 5.

High class paper or art paper whose the basis weight is 78-400 g/m$^2$, preferably 150-300 g/m$^2$ can be used as the paper 3. The base material film 4 may be bonded to the paper 3 by various methods. The base material film 4 can be laminated on the paper 3 by an extrusion laminating method. For example, a PET film is used for the base material film 4. Also, various resins such as polyethylene and polypropylene can be used for the base material film 4.

The thermal insulation layer 5 is composed of a resin containing a foaming agent or hollow bodies. A urethane resin, a vinyl acetate resin, an acrylic resin, a polyolefin resin such as polyethylene and polypropylene, and a copolymer thereof or the like can be used as the resin used herein. A so-called chemical foaming agent which generates gas by thermal decomposition can be used as the foaming agent. Examples of the foaming agents include azodicarbonamide, N,N-dinitrosopentamethylenetetramine, 4,4-oxybis (benzene sulphonyl hydrazide), hydrazodicarbonamide, barium azodicarboxylate and sodium hydrogen carbonate. Organic hollow particles such as crosslinked styrene-acryl and inorganic hollow vitreous bodies or the like can be used as the hollow bodies. The filling rate of the foaming agent or the hollow bodies is preferably set such that the ratio of voids formed in the thermal insulation layer 5 by the foaming agent or the hollow bodies to the thermal insulation layer 5 is within the range of from 30 to 50%. The thickness of the thermal insulation layer 5 is preferably within the range of from 10 to 50 μm. A method for forming the thermal insulation layer 5 will be described below.

Figure 2:
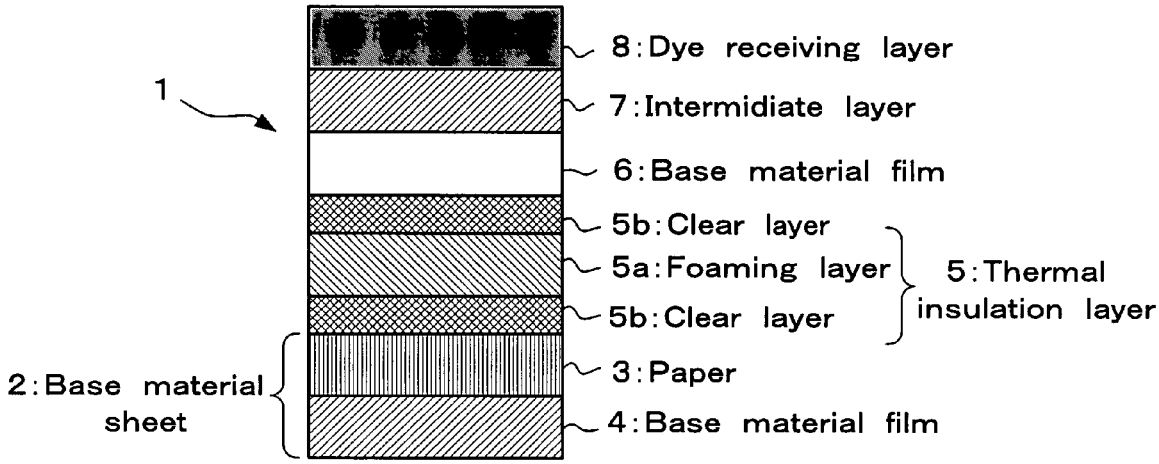
FIG. 2 is a schematic view showing another example of a thermal transfer image receiving sheet according to the invention.

It is necessary that the thermal insulation layer 5 is composed as a foaming layer by foaming the foaming agent when the thermal insulation layer 5 contains the foaming agent. The base material film 6 may be identical to the base material film 4. For example, the thickness of the base material film 6 may be about 4 to 6 μm. The thermal insulation layer 5 may have a single-layer structure shown in FIG. 1. Also, as shown in FIG. 2, the thermal insulation layer 5 may has a constitution of laminating clear layers 5*b* as a skin layer on both surfaces of a foaming layer 5*a*. In this case, the foaming layer 5*a* may be constituted by foaming the foaming agent, and may be formed by mixing the hollow bodies with the resin. In a word, the foaming layer 5*a* shown in FIG. 2 substantially corresponds to the thermal insulation layer 5 shown in FIG. 1. A clear layer 5*b* is composed of a clear resin. The clear layer 5*b* may be formed on only one of both the surfaces of the foaming layer 5*a*.

The intermediate layer 7 indicates all layers interposed between the base material film 6 and the dye receiving layer 8. The intermediate layer 7 may be a single-layer structure or a multi-layer structure. A sheet-shaped material such as non-foaming plastic film may be used for the intermediate layer 7. The thickness of the intermediate layer 7 is preferably within the range of from 2 to 20 μm. When the thickness of the intermediate layer 7 exceeds 20 μm, the thermal insulation layer 5 may not be exhibit the improvement effect of thermal insulation property and cushioning property sufficiently. The intermediate layer 7 may be arranged if necessary, and the layer 7 may be omitted.

The intermediate layer 7 may contain a known inorganic pigment such as calcium carbonate, talc, kaolin, titanium dioxide, zinc oxide and a known fluorescent brightening agent so as to attain concealing property and whiteness and so as to adjust material feeling of the whole thermal transfer image receiving sheet 1. The blending ratio thereof is preferably 10-200 parts by weight to 100 parts by weight based on the resin solid matter. When the blending ratio is less than 10 parts by weight, the effect is sufficiently exhibited. When the blending ratio exceeds 200 parts by weight, dispersion stability is lacked and the performance of the resin may not be obtained.

The dye receiving layer 8 is composed by adding various additives such as a releasing agent to varnish consisting mainly of a resin which can easily be dyed with a dye, if necessary. As the resin which can easily be dyed with the dye, a polyolefin resin such as polypropylene, a polyvinyl chloride resin, a halogenated resin such as polyvinylidene chloride, polyvinyl acetate, a vinyl resin such as polyacrylic ester, copolymers thereof, a polyester resin such as polyethylene terephthalate and polybutylene terephthalate, a polystyrene resin, a polyamide resin, a copolymer of an olefine such as ethylene and propylene and other vinyl monomer, an ionomer, a single or mixture of a cellulose derivative can be used. A polyester resin and a vinyl resin are preferable among them.

The dye receiving layer 8 may contain a releasing agent so as to prevent heat fusion with the thermal transfer sheet when forming the image. As the releasing agent, silicon oil and phosphate ester-based plasticizer fluorine compound can be used, and in particular, the silicon oil is preferably used. As the silicon oil, modified silicones such as epoxy-modified silicone, alkyl-modified silicone, amino-modified silicone, fluorine-modified silicone, phenyl-modified silicone, epoxy polyether-modified silicone are preferably used. A reaction product between the vinyl-modified silicone oil and the hydrogeno-modified silicone oil is preferable among them. The amount added of the releasing agent is preferably 0.2-30 parts by weight to the resin forming the dye receiving layer 8.

The dye receiving layer 8 is formed by a general coating method such as a roll coating method, a bar coating method, a gravure coating method and a gravure reverse coating method. The coating amount of the dye receiving layer 8 is preferably 0.5-10 g/m$^2$.

Figure 3:
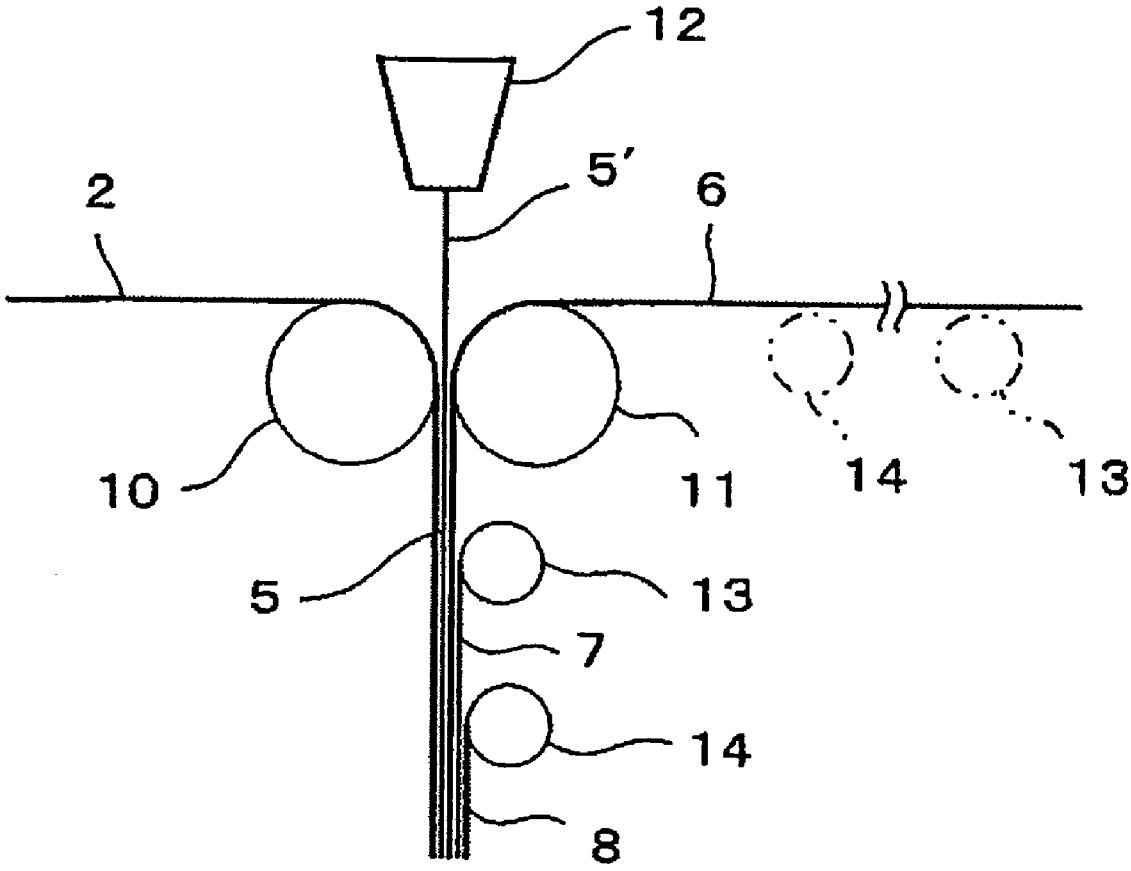
FIG. 3 is a schematic view showing an example of a method for manufacturing a thermal transfer image receiving sheet according to the invention.

Next, a method for manufacturing a thermal transfer image receiving sheet according to the invention will be described. As shown in FIG. 3, the base material sheet 2 conveyed in the horizontal direction is conveyed downward in the vertical direction while being wound around a first roll 10, and the base material film 6 is conveyed from the opposite side of the base material sheet 2 in the opposite direction of the conveyed direction of the base material sheet. The base material film 6 is conveyed downward in the vertical direction in parallel to the base material sheet 2 while being wound around a second roll 11 arranged adjacently to the first roll 10. A resin 5' containing at least one of the foaming agent and the hollow bodies is extruded from a T-die 12 arranged above the rolls 10, 11, and the base material sheet 2 and the base material film 6 are laminated via the resin 5' extruded. At the moment, the Resin 5' contains the foaming agent or the hollow bodies. The foaming agent is foamed by the release of pressure with the extrusion from the T-die 12 when the resin 5' contains the foaming agent. Temperature control such as heating the resin 5' may be performed when the resin 5' does not reach the foaming temperature. Thus, since the base material sheet 2 and the base material film 6 are bonded via the heated molten resin 5' by a so-called extrusion laminating method in the method for manufacturing according to the embodiment, it is not necessary to use a solvent type adhesive. The intermediate layer 7 and the dye receiving layer 8 are gravure-coated in order by coating rollers 13, 14 after forming from the base material sheet 2 to the base material film 6.

As shown by an imaginary line in FIG. 3, the coating rollers 13, 14 may be arranged on the further upstream side than the second roll 11, and the intermediate layer 7 and the dye receiving layer 8 may be formed before laminating the base material film 6 and the base material sheet 2. The thermal transfer image receiving sheet according to the invention can be obtained by the above procedures. The method for forming the intermediate layer 7 and the dye receiving layer 8 is not limited to a gravure coating method, and the intermediate layer 7 and the dye receiving layer 8 can be formed by using a general coating method such as a roll coating method, a bar coating method and a gravure reverse coating method.

Figure 4:
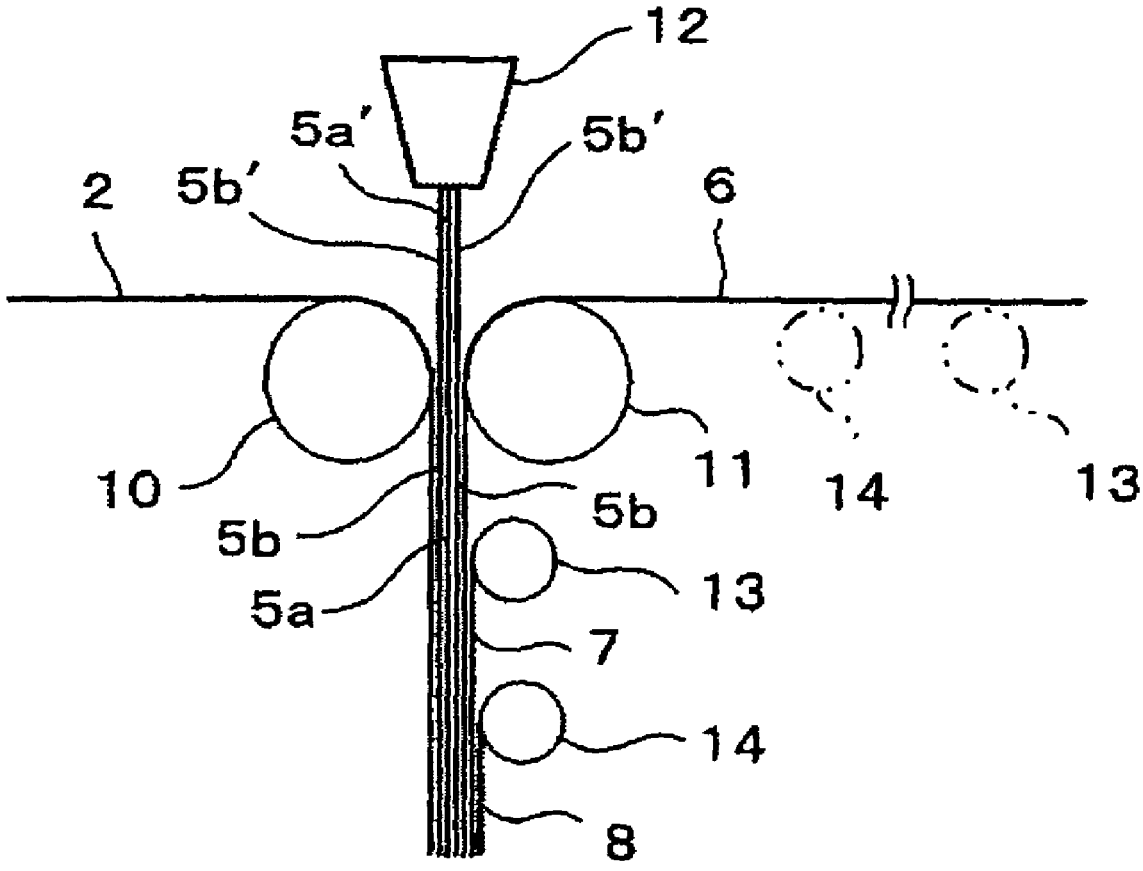
FIG. 4 is a schematic view showing another example of a method for manufacturing a thermal transfer image receiving sheet according to the invention.

When thermal insulation layer 5 is formed by laminating the foaming layer 5*a* and the clear layer 5*b* as shown in FIG. 2, the base material sheet 2 and the base material film 6 may be laminated by a co-extrusion laminating method which integrally extrudes a resin 5*a*' as a raw material of the foaming layer 5*a* and a clear resin 5*b*' as a raw material of the clear layer 5*b* from the T-die 12 as shown in FIG.4.

EXAMPLE

Now, the invention will be described more specifically by way of Examples.

Example 1

A base material sheet containing coat paper whose the basis weight was 170 g/m$^2$ and a base material film which was 4.2 μm in thickness and was made of PET were laminated by the resin to be extruded which was made of the following composition. After that, an intermediate layer and a dye receiving layer made of the following composition were coated outside of the base material film made of PET by a gravure coating method such that the coating amount of the intermediate layer and the coating amount of the dye receiving layer were respectively set to 2.0 g/m$^2$ and 4.0 g/m$^2$ at the time of drying. A thermal transfer image receiving sheet of Example 1 was then formed by drying.

(1) Resin to be Extruded

Resin (Sumikasen 10P manufactured by SumitomoMitsui Polyolefin(SMPO)) 100 parts by weight Foaming agent (Polythlene EE207 manufactured by Eiwa Chemical Ind. Co., Ltd.) 5 parts by weight (2) Intermediate Layer Polyester resin (Byron 200 manufactured by Toyobo Co., Ltd.) 10 parts by weight Titanium oxide (TCA-888 manufactured by Tohkem Products Corp) 20 parts by weight Methyl ethyl ketone/toluene=1/1 120 parts by weight (3) Dye Receiving Layer Vinyl chloride-vinyl acetate copolymer (#1000A manufactured by Denki Kagaku Kogyo Kabushikikaisha) 100 parts by weight Amino-modified silicone (X22-3050C manufactured by Shin-Etsu Chemical Co., Ltd.) 5 parts by weight Epoxy-modified silicone (X22-3000E manufactured by Shin-Etsu Chemical Co., Ltd.) 5 parts by weight Methyl ethyl ketone/toluene=1/1 400 parts by weight

Example 2

The resin to be extruded of Example 1 and a clear layer having the following composition were extruded and laminated on the base material sheet such that the clear layer was positioned at the side of the base material sheet. A thermal transfer image receiving sheet of Example 2 was formed in a manner equivalent to that described in Example 1 except the above procedure.

Clear Layer

Resin (Sumikasen 10P manufactured by SumitomoMitsui Polyolefin(SMPO)) 100 parts by weight

Example 3

The clear layer of Example 2 was extrusion-molded on both sides of the resin to be extruded of Example 1, and thereby a thermal insulation layer was composed. A thermal transfer image receiving sheet of Example 3 was formed in a manner equivalent to that described in Example 1 except the above procedure.

Example 4

A thermal insulation layer was formed by using a resin having the following composition in place of the resin to be extruded of Example 1. A thermal transfer image receiving sheet of Example 4 was formed in a manner equivalent to that described in Example 1 except the above procedure.

Extruded Resin

Resin (Sumikasen 10P manufactured by SumitomoMitsui Polyolefin(SMPO)) 80 parts by weight Hollow bodies (Taisetsu balloon manufactured by bieihakudo Corporation) 20 parts by weight Example 5

A thermal insulation layer was formed by using a resin having the following composition in place of the resin to be extruded of Example 1. A thermal transfer image receiving sheet of Example 5 was formed in a manner equivalent to that described in Example 1 except the above procedure.

Resin to be Extruded

Resin (Sumikasen 10P manufactured by SumitomoMitsui Polyolefin(SMPO)) 80 parts by weight Hollow bodies (Taisetsu balloon manufactured by bieihakudo Corporation) 20 parts by weight Foaming agent (Polythlene EE207 manufactured by Eiwa Chemical Ind. Co., Ltd.) 5 parts by weight Example 6

The intermediate layer and the dye receiving layer of Example 1 were coated on the base material film before hand. After that, the uncoated surface of the base material film and the base material sheet of Example 1 were laminated to be extruded by the resin to be extruded of Example 1, and thereby a thermal transfer image receiving sheet of Example 6 was formed.

Comparative Example 1

A thermal transfer image receiving sheet of Comparative Example 1 was formed in a manner equivalent to that described in Example 1 except that the foaming agent was omitted from the resin to be extruded of Example 1.

Evaluation Method

Next, the thermal transfer image receiving sheets of each Example and Comparative Example were evaluated as follows. (1) Method for implementing thermal transfer record . . . A transfer film UPC-740 for a sublimation transfer printer UP-D70A (manufactured by Sony Corporation) was used as a thermal transfer sheet, and the thermal transfer image receiving sheets of Examples 1 to 6 and Comparative Example 1 were used as a thermal transfer image receiving sheet which should be used in combination with the thermal transfer sheet. The dye layer of the thermal transfer sheet and the dye receiving layer of the thermal transfer image receiving sheet were superposed to be opposed mutually. The thermal transfer sheet was heated from the rear surface side thereof by a thermal head, and Y, M, C, and a protective layer were thermal transfer-recorded in the order. The thermal transfer record was performed under the following conditions.

<Thermal Transfer Recording Condition>

The gradation image was formed under the following conditions.

Thermal head: KYT-86-12MFW11 (manufacturing by Kyocera Corporation)

Average resistance of the heating element: 4412Ω

Print density in main scanning direction: 300 dpi

Print density in sub-scanning direction: 300 dpi

Applied power: 0.136 W/dot

One line period: 6 msec.

Print starting temperature: 30° C.

Print size: 100 mm×150 mm

Gradation print: A multi pulse type test printer capable of changing the number of division pulses having the pulse length in which one line period was divided equally into 256 pieces from 0 to 255 pieces for one line period was used. The duty ratio of each division pulse was fixed to 40%, and 16 gradations from one step to 16 steps were controlled such that the number of pulses per one line period was gradually increased 17 pieces each from 0 to 255 pieces, for example, 0 piece at one step, 17 pieces at two step, and 34 pieces at three step.

Transfer of protective layer: the same test printer which similar to the above test printer was used. The duty ratio of each division pulse was fixed to 50%. The number of pulses per one line period was fixed to 210 pieces, and a protective layer was transferred on the entire surface of the print body by performing a so-called solid print.

(2) Evaluation of print density . . . The maximum reflection density of the print body formed by the above procedures was measured on a visual filter by using an optical reflection densitometer (Macbeth RD-918 manufactured by Macbeth Company). The maximum reflection density of 1.7 or more was evaluated as ○, and the maximum reflection density of less than 1.7 was evaluated as x. The evaluation result will be described in the following table 1.

TABLE 1

| Sample | Print Density |
|---|---|
| Example 1 | ○ |
| Example 2 | ○ |
| Example 3 | ○ |
| Example 4 | ○ |
| Example 5 | ○ |
| Comparative Example 1 | x |

As described above, by the thermal transfer image receiving sheet according to the invention and the method for manufacturing the same, the thermal insulation layer is interposed between the dye receiving layer and the base material sheet, and the thermal insulation layer contains at least one of the foaming agent and the hollow bodies. Thereby the thermal transfer image receiving sheet has low heat conductivity and the sensitivity can enhanced. Since the base material sheet is bonded to the base material film at the time of extrusion-molding the thermal insulation layer, work for laminating the foaming film and work for coating a coating liquid can be obviated, and the thermal transfer image receiving sheet can be easily manufactured at a low cost. The solvent type adhesive which is conventionally used for adhering the foaming film to the base material sheet can be obviated, and the influence of the residual solvent can be eliminated.

What is claimed is:

1. A method for manufacturing a thermal transfer image receiving sheet including a base material sheet, a thermal insulation layer and a dye receiving layer, comprising the steps of:

bonding the base material sheet and a base material film without using adhesive, via a heated molten resin containing at least one of a foaming agent and hollow bodies, while extrusion-molding the resin to form the thermal insulation layer between the base material sheet and the base material film, so that the base material sheet and the base material film are laminated via the thermal insulation layer; and forming the dye receiving layer outside of the base material film.

2. The method for manufacturing a thermal transfer image receiving sheet according to claim 1, wherein the dye receiving layer is formed after bonding the base material sheet to the base material film.

3. The method for manufacturing a thermal transfer image receiving sheet according to claim 1, wherein the dye receiving layer is formed before bonding the base material sheet to the base material film.

4. The method for manufacturing a thermal transfer image receiving sheet according to claim 1, wherein the resin contains the foaming agent, and the foaming agent is foamed while being extruded and molded.

5. The method for manufacturing a thermal transfer image receiving sheet according to claim 1, wherein when the thermal insulation layer formed, the thermal insulation layer is formed to be multitiered with a skin layer extrusion-molded integrally on at least one side of the resin, the skin layer comprising none of the foaming agent and hollow bodies.

* * * * *